US005800652A

United States Patent [19]

Vigneau et al.

[11] Patent Number: 5,800,652

[45] Date of Patent: *Sep. 1, 1998

[54] METHOD AND APPARATUS FOR TAIL SEALING OF CONVOLUTELY WOUND WEBS

[75] Inventors: Richard J. Vigneau, Green Bay; Gerald W. Buxton, Shawano; Richard C. Dvorak, Green Bay, all of Wis.

[73] Assignee: Paper Converting Machine Co., Green Bay, Wis.

[ * ] Notice: The term of this patent shall not extend beyond the expiration date of Pat. No. 5,573,615.

[21] Appl. No.: 575,908

[22] Filed: Dec. 20, 1995

Related U.S. Application Data

[63] Continuation-in-part of Ser. No. 437,810, May 9, 1995, Pat. No. 5,573,615.

[51] Int. Cl.[6] ..... B32B 31/00; B65H 81/00

[52] U.S. Cl. ..... 156/184; 156/191; 156/449; 156/450

[58] Field of Search ..... 156/184, 187, 156/191, 193, 446, 448, 499, 450, 456, 457, 458; 118/243

[56] References Cited

U.S. PATENT DOCUMENTS

| | | |
|---|---|---|
| 3,044,532 | 3/1962 | Ghisoni . |
| 3,179,348 | 4/1965 | Nystrand et al. . |
| 3,553,055 | 1/1971 | Janik . |
| 3,926,299 | 12/1975 | Bradley et al. . |
| 3,939,105 | 2/1976 | Tellier, Jr. . |
| 3,963,223 | 6/1976 | Biagiotti . |
| 4,026,752 | 5/1977 | Hartbauer et al. . |
| 4,475,974 | 10/1984 | Perini . |
| 4,909,452 | 3/1990 | Hertel et al. . |
| 5,242,525 | 9/1993 | Biagiotti . |
| 5,259,910 | 11/1993 | Biagiotti . |

FOREIGN PATENT DOCUMENTS

| | | |
|---|---|---|
| 541 496A | 11/1992 | European Pat. Off. . |
| 0623 540 | 11/1994 | European Pat. Off. . |
| 50-35562 | 11/1975 | Japan . |
| 1 495 445 | 12/1977 | United Kingdom . |
| 95/15902 | 6/1995 | WIPO . |
| 95/15903 | 6/1995 | WIPO . |

OTHER PUBLICATIONS

Patent Abstracts of Japan vol. 12, No. 206 (M–708), 14 Jun. 1988 & JP 63 008164 A (Dainippon Printing) Jan. 1988.

D.N. Godard, "Self–Recovering Equalization and Carrier Tracking in Two–Demensional Data Communication Systems", IEEE Transactions on Communications, vol. COM–28, No. 11, Nov., 1980, pp. 1867–1875.

N.K. Jablon, "Joint Blind Equalization, Carrier Recovery, and Timing Recovery for High–Order QAM Signal Constellations", IEEE Transactions on Signal Processing, vol. 40, No. 6, Jun. 1992, pp. 1383–1398.

M.C. Sullivan, "A Signed Maximum Correlation Multiplier for LMS Filter Adaptation", IEEE Transactions on Signal Processing, vol. 41, No. 1, Jan., 1993, pp. 147–151.

V.J. Mathews and S.H. Cho, "Improved Convergence Analysis of Stochastic Gradient Adaptive Filters Using the Sign Algorithm", IEEE Transactions on Acoustics, Speech, and Signal Processing, vol. ASSP–35, No. 4, Apr. 1987, pp. 450–454.

*Primary Examiner*—James Engel

[57] ABSTRACT

A method and apparatus for sealing the tail of a convolutely wound log which include a longitudinally extending path, an infeed station and a sealing station in the path, equipping the infeed station with a pair of spaced-apart, rotatable rollers, providing one of the rollers with vacuum ports in the periphery thereof, feeding logs sequentially into the nip space between the pair of rollers, rotating the rollers, orienting the log tail to a position over the ports in the one roller, rotating the rollers to unwind the tail, and rolling each log in the path into the sealing station; the unwinding being either (a) triggered by a mark on the tail such as a UV ink stripe or (b) using an air blast.

31 Claims, 7 Drawing Sheets

METHOD AND APPARATUS FOR TAIL SEALING OF CONVOLUTELY WOUND WEBS

This application is a continuation-in-part application of our application Ser. No. 08/437,810, filed May 9, 1995 now U.S. Pat. No. 5,573,615.

BACKGROUND AND SUMMARY OF INVENTION

This invention relates to method and apparatus for tail sealing of convolutely wound webs and, more particularly, to elongated logs such as are produced in manufacturing bathroom tissue and kitchen toweling products.

Webs are often "rewound" into retail sized logs. As exemplified by bathroom tissue and kitchen toweling, the webs from the paper machine are normally wound into a jumbo roll of 5 to 10 feet in diameter and 100 to 200 inches in axial length. These jumbo rolls are then transferred to a "rewinder" where they are rewound into the consumer sized diameter product, viz., 5 to 10 inches in diameter but with an axial length of the original jumbo roll. During this rewinding, the web is normally transversely perforated on 4-½" centers for bathroom tissues and 11" for kitchen toweling. Subsequently, these logs are transversely sawed into shorter axial lengths, i.e., 4-½" for bathroom tissue and 11" for kitchen toweling so that the "squares" of web material can be unwound and detached. The rewinding normally results in a "loose" tail on the outside of the log which could interfere with either or both of the transverse sawing and the ultimate roll packaging. Therefore, for the last 35 years, tail sealing has been performed and illustrative of an early commercial machine is U.S. Pat. No. 3,044,532. This provided the basic technology of unwinding the tail from the completed log by means of an air blast, introducing adhesive between the unwound tail and the underlying convolution, and then rolling the partially unwound log on itself to rewind the tail on the log.

Two widely employed improvements are seen in U.S. Pat. Nos. 3,393,105 where adhesive was applied to the tail and 4,026,752 where adhesive was applied to the convolution underlying the tail.

U.S. Pat. No. 4,475,974 discloses a chain conveyor for positioning a log in different stations for unwinding, glue application and rewinding. U.S. Pat. No. 4,963,223 discloses an orbiting tail sealer with stations for unwinding and gluing.

A Japanese 1975 Publication No. 50-35562 discloses an adhesive applicator which is positioned underneath a log to apply adhesive upwardly to one or both of the draped tail and/or underlying log convolution. U.S. Pat. No. 5,259,910 shows another conveyor-type tail sealer where adhesive is applied from the underside of the log. So also does PCT Publication WO 95/15902.

A 1977 British Publication 1 495 445 discloses a tail sealer where the tail is immobilized by vacuum so as to permit an orbiting brush to apply adhesive to the underlying log. Another type of vacuum system was employed in U.S. Pat. No. 3,553,055 and later in U.S. Pat. No. 5,242,525. Vacuum was also used in EPO Publication 0 623 540 A1 and in PCT publication WO 95/15903.

The invention provides an apparatus and a method for sealing the tail of a convolutely wound log which includes the steps of providing a longitudinally extending path with an infeed station and a sealing station in the path. The infeed station is equipped with a pair of spaced-apart, rotatable rollers with one of the rollers having vacuum port means in the periphery thereof. Logs are fed sequentially into the nip space between the pair of rollers which are then rotated to orient the log tail to a position over the vacuum port means. Thereafter, the rollers are rotated to unwind the tail. After that, each partially unwound log is rolled into the sealing station. The sealing station provides a novel and advantageous glue applying structure which operates from the underside.

The novel infeed mechanism can be used with either of two tail unwinding systems. One utilizes a mark on the tail portion of the log to be sensed for developing a predetermined amount of tail and the other makes use of a more conventional air blast. Both cooperate advantageously with the above-mentioned roller pair where one has the vacuum port means.

Other objects and advantages of the invention may be seen in the details of construction and operation set forth in the ensuing specification.

BRIEF DESCRIPTION OF DRAWING:

The invention is described in conjunction with the accompanying drawing, in which.

DETAILED DESCRIPTION

Figure 1:
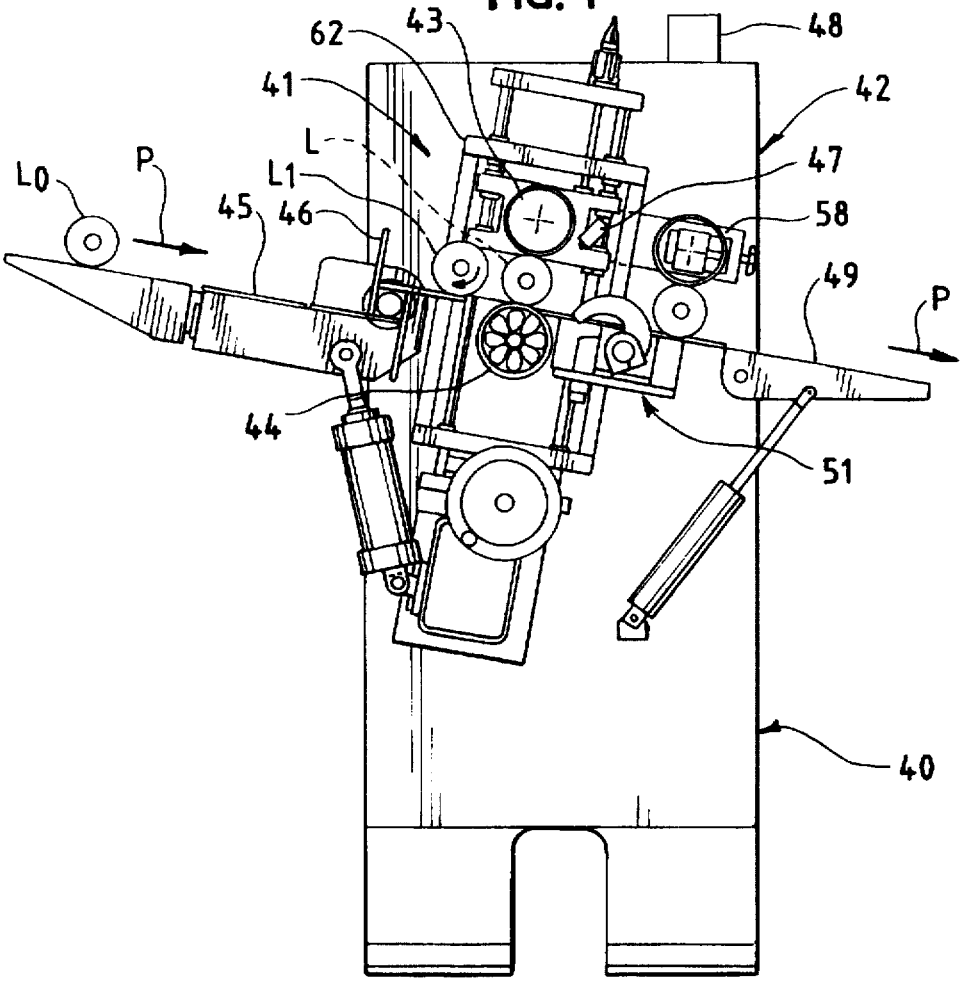
FIG. 1 is a side elevation of a tail sealer embodying teachings of this invention.
Figure 2:
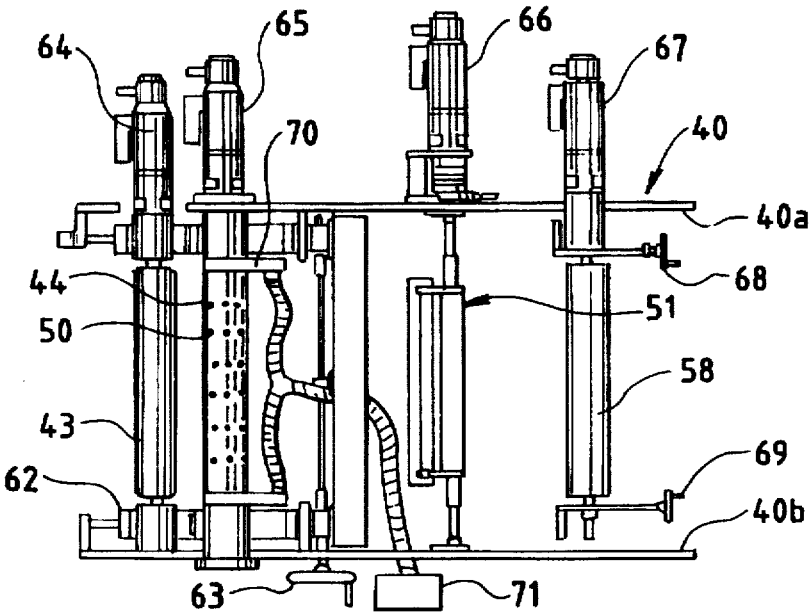
FIG. 2 is a developed plan view of the sealer seen in FIG. 1.

Referring first to FIG. 1, the numeral 40 designates generally the frame of the tail sealing apparatus which includes the infeed station generally designated 41 and the sealing station generally designated 42. As seen in FIG. 2, the frame includes a pair of side frames **40*a* and 40*b* which define a generally longitudinally extending path P see FIG. 1. Extending between the side frames and rotatably supported therein are the rollers 43 and 44** which are employed to provide a predetermined length of tail.

Still referring to FIG. 1, a wound log Lo enters frame 40 via infeed ramp 45, and is stopped and aligned by paddle wheel 46. The paddle wheel 46 then rotates 90° to advance the log $L_1$ into the infeed station generally designated 41. The paddle wheel 46 operates both to advance logs sequentially in proper timed relation and to maintain the axes of the logs perpendicular to the path P—see respectively the left and right center portions of FIG. 1.

Rollers 43 and 44 are running in the same rotation with one of the rollers running faster than the other to advance the incoming log into the nip spacing between the rollers—see the log in the position designated L. As can be appreciated from a consideration of FIG. 4, the term "same rotation" means opposite directions when the portions of the rollers contacting the log are going in opposite directions, viz., counterclockwise for the upper roller 43 and counterclockwise for the lower roller 44.

A photoeye detector 47 senses the log L when it has reached a predetermined position—as with its axis being aligned with the axes of the rollers 43, 44. The detector 47 delivers a signal to the controller 48 to change the speed of the rollers to a matched speed—which holds the log from advancing while rotating in the nip spacing between rollers 43, 44. A suitable controller 48 is a master processor of a type PIC 900 available from Giddings & Lewis located in Fond du Lac, Wis. The controller 48 is advantageous in regulating all or controlling all of the functions in the tail sealing apparatus starting from the time the logs advance down the infeed ramp 45, through the control paddle wheel 46, through the infeed station 41, through the sealing station 42 and out the exit ramp 49.

Figure 30:
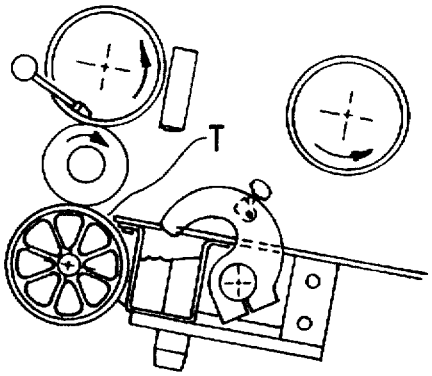

As will be brought out hereinafter, the invention provides two ways of developing a partial wrap of the lower roller 48 with a predetermined amount of tail—see the tail T in FIG. 13 and again in FIG. 30. For holding the tail T against the roller 44, this roller is equipped with vacuum ports as at 50—see FIG. 2. There, only a few are illustrated but it will be appreciated that the entire peripheral surface of the roller 44 is equipped with vacuum ports arranged so as to adhere the web of the log to the surface of the roller 44.

Figure 4:
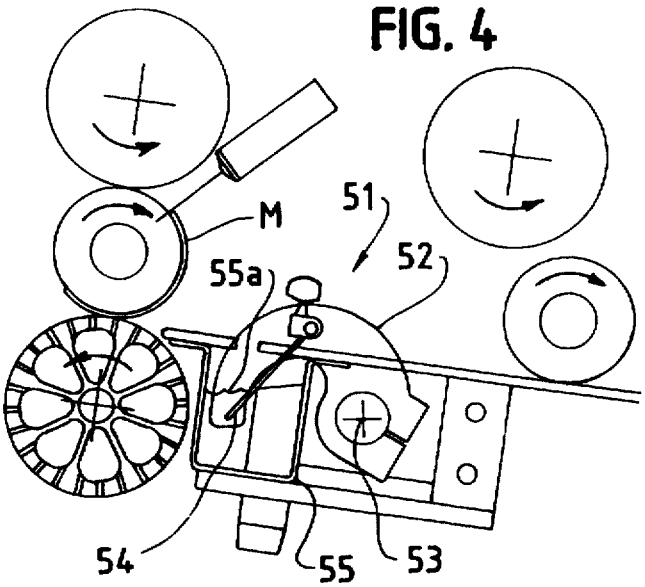
FIG. 4 is a side elevational view like FIG. 1 with the elements thereof arranged for developing a tail on a log carrying a mark as seen in FIG. 3.
Figure 5:
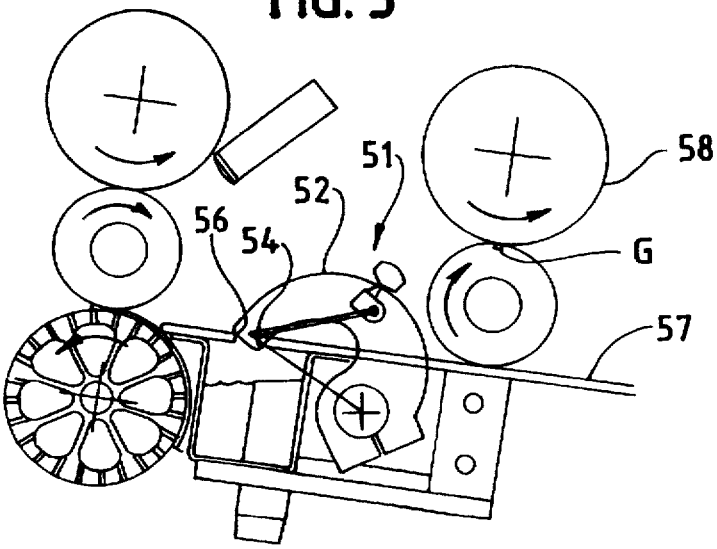
FIG. 5 is a view similar to FIG. 4 but showing the elements arranged for glue striping of a log.
Figure 13:
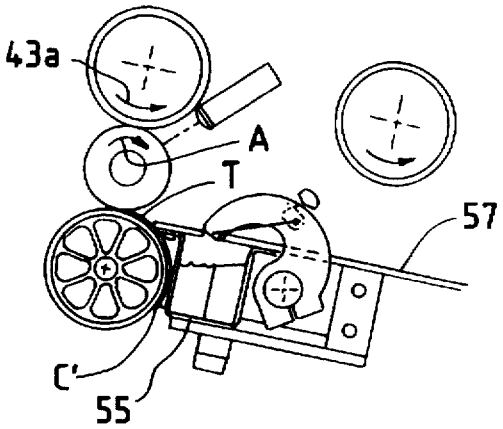

After the log has reached the partially unwound state depicted in FIGS. 13 and/or 30, the upper roller 43 is rotated so as to eject the log L out of the nip spacing between the rollers 43, 44 and over the glue applicator generally designated 51—see especially FIGS. 4 and 5. The glue applicator includes a pair of arms 52 which are pivotally mounted on a portion of the frame as at 53. The arms 52 carry therebetween a wire 54. In FIG. 4, the wire 54 is seen immersed in the liquid 55*a* in glue cannister 55 while in FIG. 5 it has been pivoted upwardly into a slot 56 in the table 57. As the log rolls on the table 57, it passes over the wire 54 which is now slightly above the level of the table 57 by virtue of passing through the slot 56 and applies a line of glue to the partially unwound log.

The log then continues down the table 57 and contacts presser roller 58—see FIG. 5. The roller is positioned to be directly above the glue line G as the log rotates from the glue applicator to the 12:00 position in its first revolution. This position, of course, changes with log diameter. The roller 58 which is running at a speed to match the velocity of the log, presses the tail slightly at the point of the fresh glue line G and ejects the log down the table 57 for further processing—as by a log saw (not shown).

First Embodiment

In the first embodiment, tail detection makes use of an ink marker (prelocated during the winding operation) on the tail of the log. A suitable rewinder is either of the center wind type (U.S. Pat. No. 3,179,348) or surface wind type (U.S. Pat. No. 4,909,452).

Figure 3:
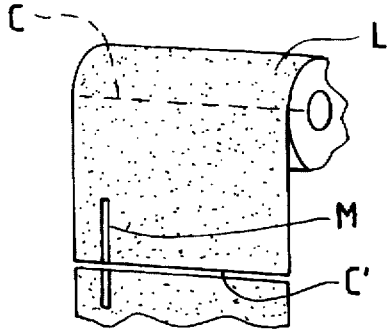
FIG. 3 is a fragmentary perspective view of a wound log as it comes out of a rewinder (not shown)

The marker is illustrated in FIG. 3 where a fragment of a log L is shown. During winding, the web ultimately wound into log L is cross perforated as at C. Also during the wind, a longitudinally extended stripe or marking M is applied to extend on both sides of a predetermined or preselected line of cross perforation C'. The preselected line C' is determined by the desired sheet count and at the end of the wind, the web is cut off at line C'.

More particularly, a short pulse of ink is sprayed on the web in the rewinder line before cutoff. The finished wound product then has several inches of ink partway around its circumference with a very defined end where the cutoff occurs. Since the log is always rotated in a wind up rotation, it is easy to locate the end of the ink defining the tail.

As the log L is located between the rollers 43, 44 and rotated, the end of the marker M, which may be ultra violet (UV) ink, is sensed by a companion photoelectric eye 47' (this being seen in the upper left in FIG. 8), and the log rotated to a specific or predetermined orientation.

Figure 6:
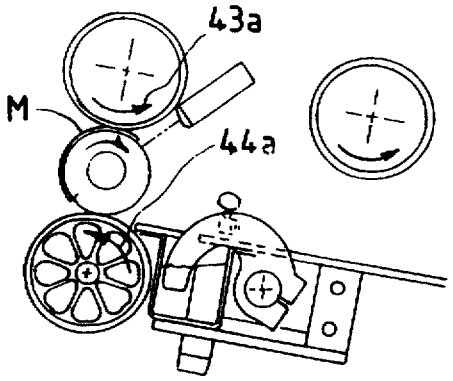
FIGS. 6–17 are sequence views comparable to FIGS. 4 and 5 but reduced in scale and showing how the tail sealing occurs in the first embodiment—using logs having a sensing mark thereon as in FIG. 3.

Reference now will be made to the sequence views FIGS. 6–17. In FIG. 6, the upper roller is rotating counterclockwise as indicated by the arrow 43*a*. To provide the same rotation, the lower roller is rotating counterclockwise as is indicated by the arrow 44*a*. When these rotations are of the same magnitude, i.e., the same speed, the log L is maintained in place in the nip or spacing between the two rollers 43, 44. In FIG. 6, the marker M is shown in heavier line and has a length (as illustrated) of about one-half the circumference of the log L.

Figure 7:
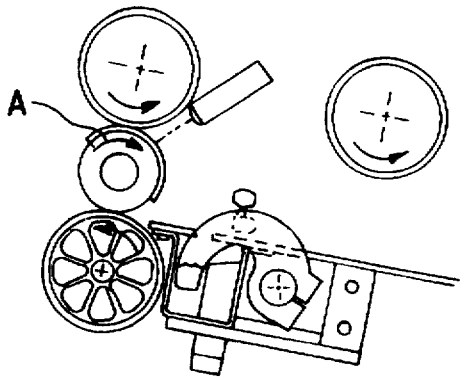
Figure 12:
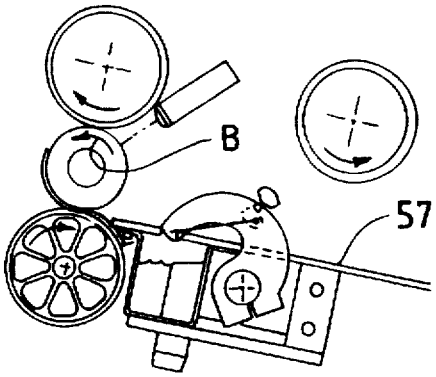

The log L is rotating clockwise as can be seen from the arrow thereon in FIG. 6 and continues to rotate in that fashion as seen in FIG. 7—see the arrow marked A. This continues until the trailing edge C' of the tail T is sensed by the photoelectric eye 47' (see FIG. 8) which then sends a signal to the controller 48. The controller 48, via servo controls (not shown) rotates the log a predetermined amount through the condition of FIG. 9 until the condition of FIG. 10 is reached. As indicated in FIG. 9, the log is still rotating in the direction of the arrow A but in FIG. 10, the rotation has stopped—there being no arrow applied to the log. In FIG. 10, the leading edge C' of the tail is in the 12:00 position relative to the log and directly on the bottom of the roller 43. The vacuum is then turned on in the roller 44 and a portion C" rearward of the tail edge C' is then anchored to the surface of the roller 44—by the vacuum in ports 50. The roller 44 is then quickly reversed (see FIG. 11) along with the upper roller 43 as at 44*b* and 43*b*, respectively. This starts to unwind the tail as is illustrated in FIG. 12—with the counter rotation or reverse rotation of the log now being designated by the symbol B. This unwinding continues through the condition of FIG. 12 until a predetermined position of the tail T is reached below the table 57 (see FIG. 13). This can be programmed into the controller inasmuch as it would be difficult to sense the end of the tail C' because of the interposition of machine elements, notably the table 57 and the glue cannister or tank 55.

Figure 14:
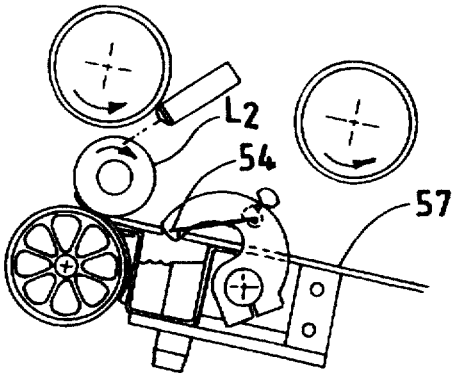
Figure 15:
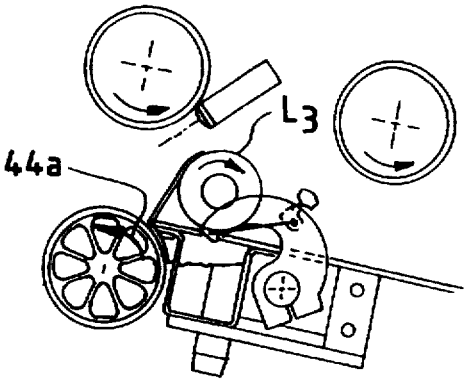

Still referring to FIG. 13, it will be noted that the rotation of the roller 44 has returned to its original condition as indicated by the arrow designated 43a and the log now rotates as it did originally as designated by the arrow A. At this time, the lower roller 44 is not rotated and the re-reversal of the rotation of the upper roller 43 ejects the log L as can be seen in FIG. 14. There the log is designated $L_2$ and is seen to be entering onto the table 57 for engagement with the wire 54. At this time, the wire 54 has been moved upwardly (compare FIG. 9) so as to be positioned in the slot 56—see FIG. 5.

A very short time later, the lower roller 44 is rotated in its original direction 44*a* (see FIG. 15) to feed the tail out past the upper end of the table 57 and to accommodate the rolling motion of the log $L_3$.

Figure 8:
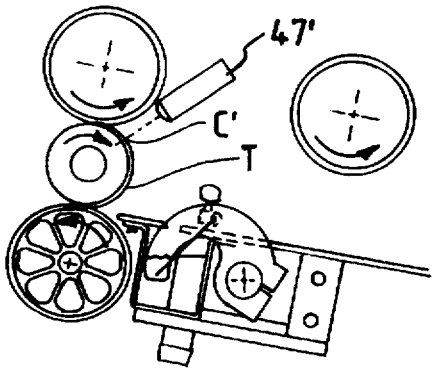
Figure 9:
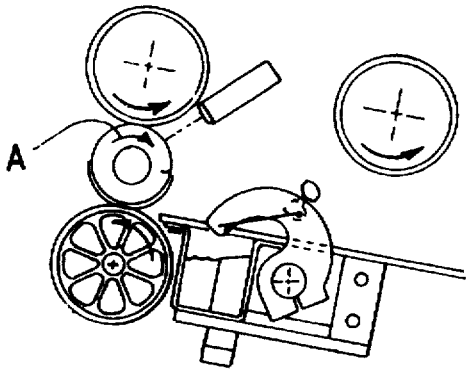
Figure 10:
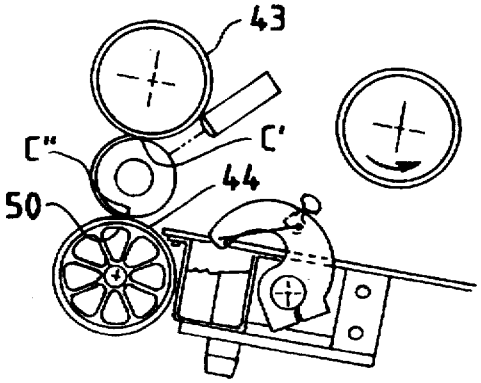
Figure 11:
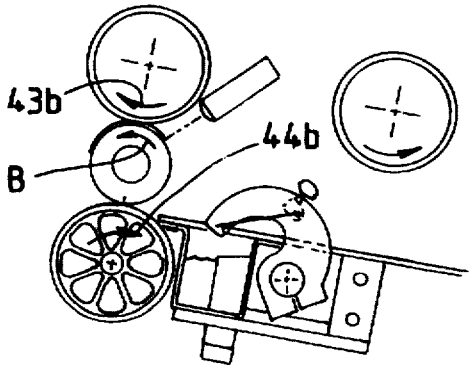

More particularly, at the time the mark M on the log is detected in the infeed roller station, the glue applicator 51 starts to pivot the glued wire 54 out of the glue pan 55 up to a predetermined position slightly above the discharge table 57 (compare FIGS. 8 and 9 as well as FIGS. 4 and 5). As mentioned above, the log at this point (shortly after the showing in FIG. 13) is ejected out of the infeed rollers 43, 44 and rolls over the glued wire 54.

Figure 16:
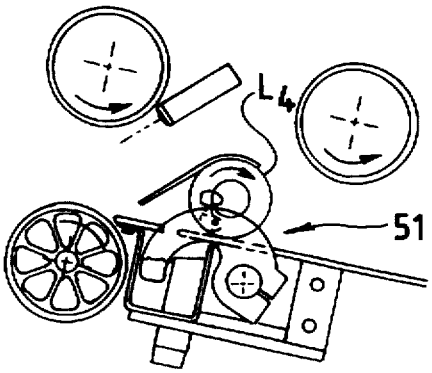

The log in the position $L_4$ continues its downward movement on the table 57 as illustrated in FIG. 16. Ultimately (see FIG. 17), the log $L_5$ contacts a roller 58 as mentioned previously with respect to the showing of FIG. 5.

Figure 17:
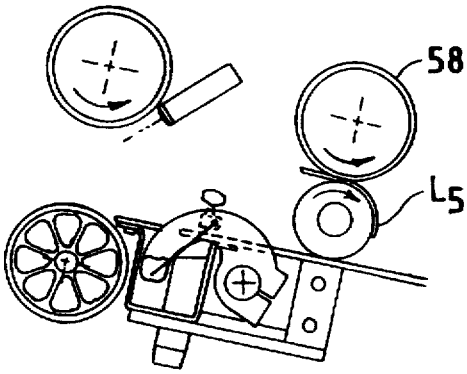

It is also advantageous in some instances to supply a second roller (not shown) beneath the wound log when it reaches the pressing station shown in FIG. 17. This aids in positioning the tail in a certain position for discharge from the tail sealer. Depending upon the desired rotational position, this can be done with a predetermined speed differential to rotate the log to a predetermined orientation before ejecting it, or by holding the log between the rollers until it reaches the predetermined orientation—as by rotating in place and then changing speed of one of the rollers to discharge the log.

The next cycle starts when the tail of a following log has been detected by the photoelectric eye or detector 47', the paddle wheel 46 starts to rotate and the log is delivered to the infeed rollers at a time when the previous log is ejected out of the rollers 43, 44.

The glue applicator 51 is an example of many which can be used for glue application, as taught by the earlier Japanese Publication 50-35562. The applicator can be a wire, a rectangular or round bar, a fountain, a grooved roller, or a spray. Those applicators which can be below the applicator station table allow the tail seal to be operated with the conventional air blast detection system to find the tail. The tail can be blown open over the glue applicator and then wound up to the point the tail is directly above the lower roller, the glue applicator 51 such as a wire can then be raised in the normal manner in time for the log to rotate over it. The air blast method typically requires reduced roller speeds in order to locate the tail, and would therefore operate slightly slower than the UV detection method.

Figure 18:
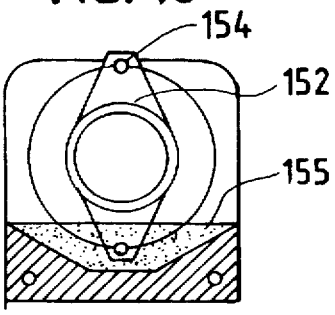
FIG. 18 is a fragmentary side elevational view of a modified form of adhesive applicator from that seen in the preceding views.
Figure 19:
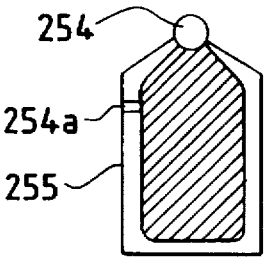
FIG. 19 is a fragmentary sectional view of yet a further modified form of adhesive applicator.
Figure 20:
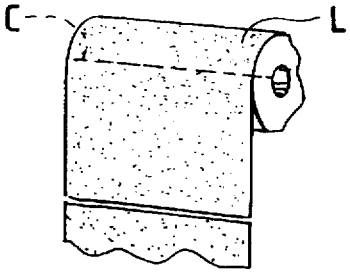
FIG. 20 is a view similar to FIG. 3 but of an unmarked log as would be used in the air blast embodiment.

Other forms of glue applicators may be employed. In some instances, it is advantageous to apply the adhesive to the tail. In either case, the constructions of FIGS. 18 and 19 may be employed. In FIG. 18, a coated wire 154 is stretched between a pair of end plates one of which is designated 152. The wire is rotated in a pan of adhesive as at 155 and up to a top vertical position for the product, i.e., either log or tail, to be "walked over" the glued wire, thereby applying the adhesive. An alternative is to make use of a rod applicator as shown in FIG. 19 where a rod 254 is positioned at the top of a housing 255 containing adhesive. The rod 254 applies adhesive in a precise amount by variable speed of the rod itself and variable flow rate of the adhesive as introduced through port 254*a*.

Second Embodiment

Figure 21:
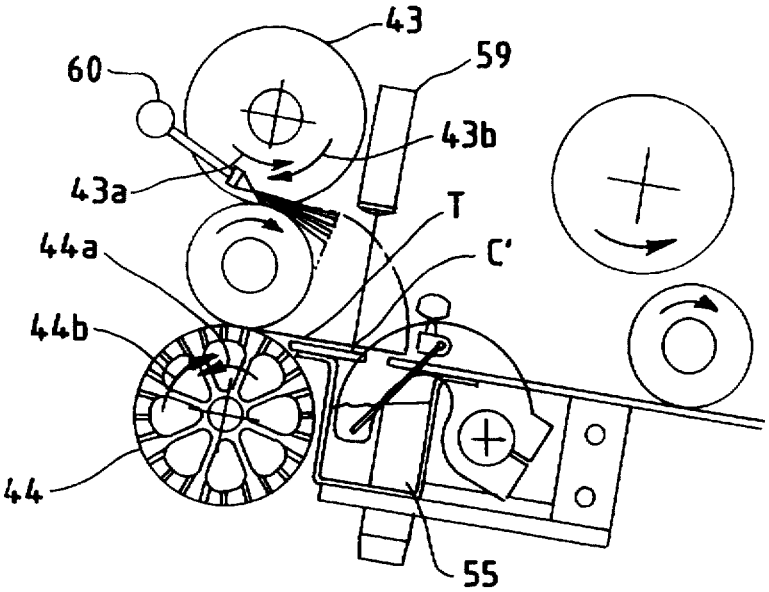
FIGS. 21 and 22 are views similar to FIGS. 4 and 5 but directed to a second embodiment where there is no mark to be sensed but instead the tail is opened by an air blast.

This method, which is alternative to the marker detection method, makes use of an air blast and also can be used to advantage with the vacuum-equipped lower roller. Inasmuch as most of the elements in this embodiment are the same as in the first embodiment (compare for example FIGS. 21 and 22 with FIGS. 4 and 5) the same numerals will be used for the same elements and new numerals (still in the double digit series) will be used for the elements which have changed. More particularly, the changed elements are essentially the detection means as at 59 and the air blast means as at 60—see the upper portion of FIG. 21.

The method of operating this second embodiment includes essentially the tail being blown open as it rotates past the upper roller 43. It is blown open over the glue pan 55 and table 57 as indicated by the symbol T applied to FIG. 21. When the rotation of the roller 43 is changed from the direction of the arrow 43*a* to the direction of the arrow 43*b* (and the same applies to roller 44 as at 44*a*, 44*b*), the tail T is in the process of being rewound and when the edge C' is sensed by the detector 59, the counter rotation as indicated at 43*b*, 44*b* is again reversed as at 43*a* and 44*a* in FIG. 22.

This summary of operation can be appreciated better from a consideration of FIGS. 23–34.

Figure 22:
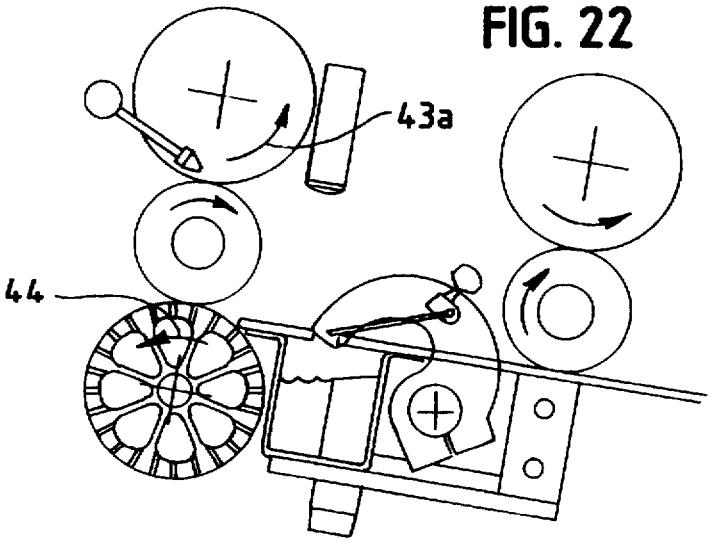
Figure 23:
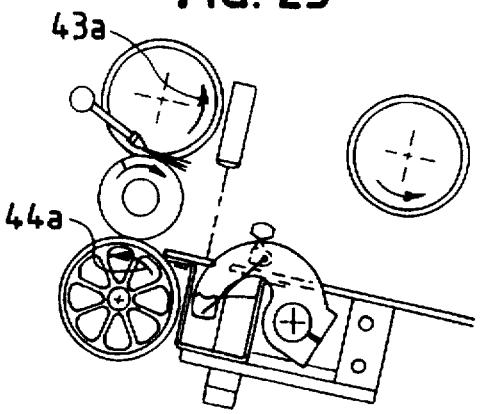
FIGS. 23–34 are sequence views similar to FIGS. 6–15 but where the air blast modification is employed.

In FIG. 22, the upper roller 43 is rotating counterclockwise as indicated by the arrow 43*a* and the lower vacuum-equipped roller 44 is rotating counterclockwise as is designated by the arrow 44*b*. This corresponds generally to the showings in FIGS. 6–8 of the first embodiment.

Figure 24:
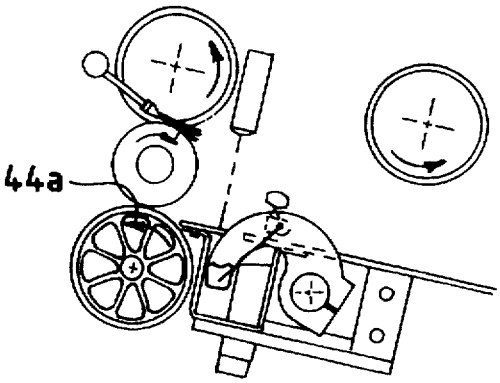
Figure 25:
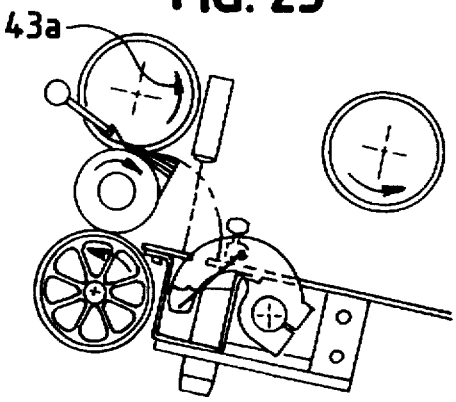
Figure 26:
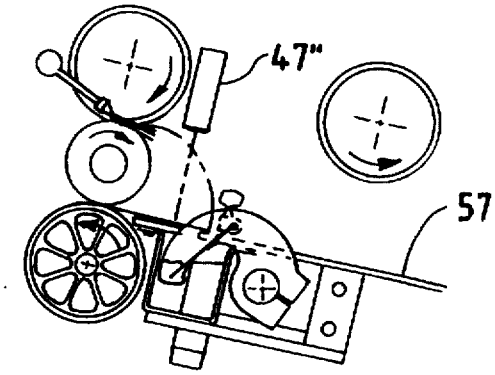

The air blast continues through the showings in FIGS. 24–26 to blow the tail down onto the table 57 as seen in FIG. 26 and where it is in the process of being sensed by a photo electric eye 47".

Figure 27:
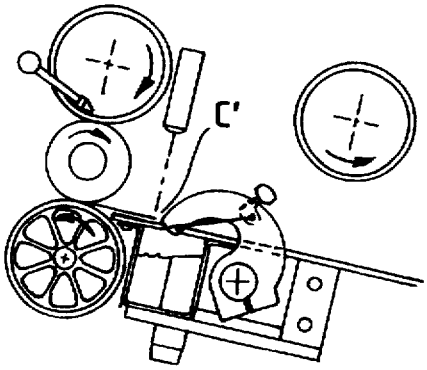
Figure 28:
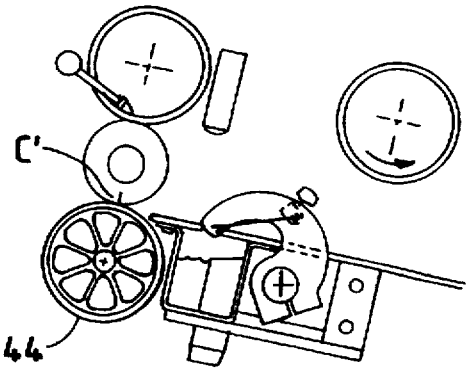
Figure 29:
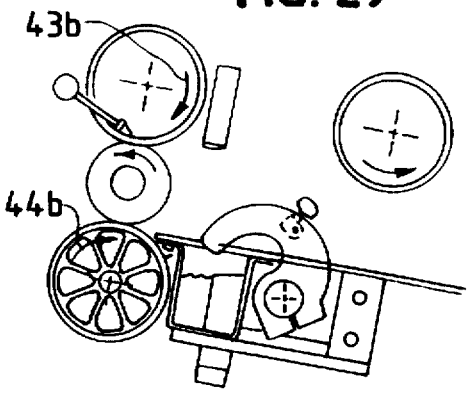

Meanwhile, as seen in FIG. 27, the rollers 43 and 44 continue their same rotation causing the log L which is in the nip or spacing between the rollers 43, 44 to continue to rotate and start rewinding the tail from the showing in FIG. 26 to that in FIG. 27. At that point, the end of the tail as at C' is sensed by the photo electric eye 47" and a signal is sent to provide a predetermined further rotation until the end of the tail as at C' is directly on top of the lower roller 44—see FIG. 28. At this point, both rollers 43 and 44 are stopped (no rotation arrows being shown in FIG. 28). Thereafter reverse or counter rotation is initiated as indicated by the arrows 43*b* and 44*b* in FIG. 29. This results in unwinding a predetermined amount of tail as seen in FIGS. 29 and 30. The extent of the unwound tail T in FIG. 30 is normally about as far as the log is unwound and, at that time, the controller re-reverses the rotation to bring about the rotation indicated by the arrow 43*a* in FIG. 31. For a moment, there is no rotation in the lower roller 44.

The showings in FIGS. 31–36 correspond essentially to the showings in FIGS. 14–17. In other words, in FIG. 31 the log $L_2$ is commencing its rolling down table 57 and the tail is being pulled along with it—at this particular time, there is no rotation of the lower roll 44. It will be appreciated that times involved here are very short, particularly when it is considered that the rewinders have an output of at least about 25 to 30 and above logs per minute. Therefore, for a tail sealer to keep up with a rewinder, a log must be processed through the tail sealer in less than about 2 seconds.

Figure 31:
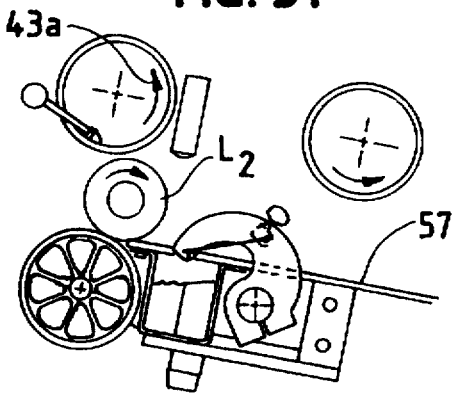
Figure 32:
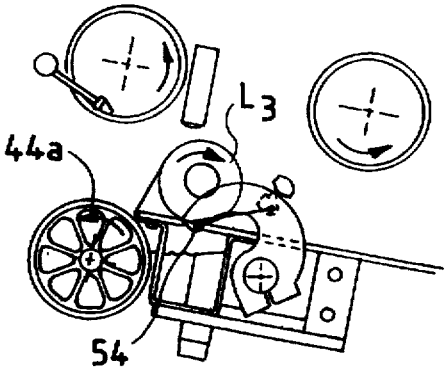

So, in FIG. 31, the log $L_2$ has been ejected from the nip between the rollers 43, 44 and this motion of the log starts to pull a small amount of the tail with the log $L_2$. Thereafter, the showing in FIG. 32 is reached where the lower roller 44 now has started to rotate in its original direction as at 44*a* to pay out the tail T as the log $L_3$ moves down the table 57. Also as indicated in FIG. 32 and corresponding to the showing in FIG. 15, the log $L_3$ is passing over the glue coated wire 54 to receive an axially-extending stripe or line of glue.

Figure 33:
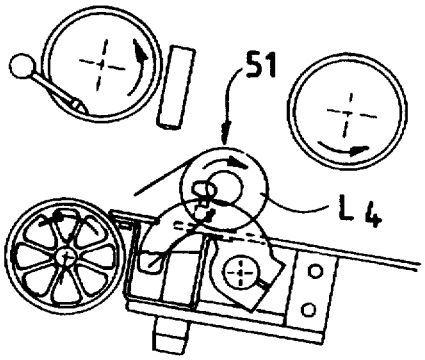

Thereafter, the elements of the apparatus assume the position depicted in FIG. 33 which corresponds to that of FIG. 16 and wherein the glue applicator 51 is pivoting to bring the wire 54 back down into the glue canister 55.

Figure 34:
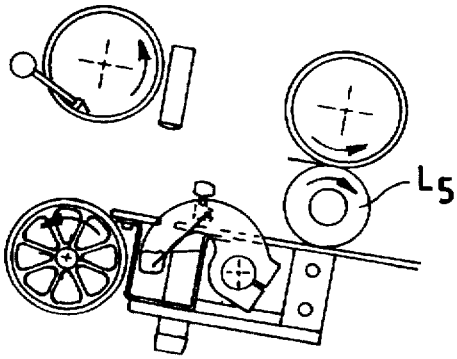

Lastly, the tail is pressed down as seen in the showings of FIGS. 17 and 34 and explained with respect to the log $L_5$ in respect to FIG. 17.

Structural Details

As seen in the upper left hand portion of FIG. 1, the two rollers 43, 44 are rotatably mounted on a subframe 62. These rollers are spaced apart a distance to accommodate the diameter of the log having been wound in the usual accompanying rewinder (not shown). Adjustment of the spacing between the rollers 43, 44 is made by a hand wheel 63—see the lower left in FIG. 2—which spaces the upper roller 43 away from the lower roller 44 a distance slightly less than the target diameter, this for traction. Initially, the upper roller 43 runs slightly faster than the lower roller 44 to initiate forward movement of the log $L_1$ into the spacing or nip between the rollers 43, 44. When the log reaches the center between the rollers 43, 44—as in the position L—it is sensed by the photo electric eye or sensor 47. The sensor includes a cell and may be of type Tempsonics available from MTS Sensors Div. located in Charlotte, N.C. When the log is in the L position of FIG. 1, i.e., with its axis aligned with the axes of roller 43, 44, the sensor 47 signals the upper roller 43 to match the speed of the lower roller 44, thereby temporarily holding the log L in the nip between the two roller 43, 44. The rotation of the rollers 43, 44 and therefore log L is achieved by motors 64, 65—see the upper left portion of FIG. 2.

In the right hand portion of FIG. 2, the glue applicator 51 is seen to be powered by motor 66 while the roller 58 is driven by motor 67. Further, the position of the roller 58 is adjusted by the handwheels 68, 69.

Also shown in FIG. 2 is the vacuum means for the roll 44. These consist of vacuum valves 70 and a pump 71.

Summary

The invention provides a method and apparatus for sealing the tail of a convolutely wound log which includes the steps of providing a longitudinally extending path P, an infeed station 41 and a sealing station 42, both in the path. We equip the infeed station with a pair of spaced-apart, rotatable rollers 43, 44 and provide one of the rollers 44 with vacuum port means 50 in the periphery thereof. The invention includes means for feeding logs L sequentially into the nip space between the pair of rollers 43, 44, rotating the rollers as at 43*a*, 44*a* to orient a portion of the log tail C" to a position over the port means (see FIG. 10), rotating the rollers to unwind the tail (see FIGS. 11 and 28), and rolling each log in the path into the sealing station (see FIGS. 12 and 29), and rolling each log in the path into the sealing station 42. The steps also include rotating the log on its axis in one direction to achieve positioning the tail in engagement with the port means (see FIGS. 10 and 28) and then stopping the rotation of each log when the tail is engaged by the vacuum port means, and retaining the tail on the vacuum port means while counter-rotating the log as at 43*b*, 44*b* to create a partially unwound log (see FIGS. 11–12 and 29), and then stopping the log counter-rotation and rolling the partially unwound log in the path toward the sealing station (see FIGS. 13–14 and 30–31). The steps also include the partially unwound log over a glue applicator for receipt of glue and while dragging the tail in the path (see FIGS. 15–17 and 33–34).

The invention may be summarized as rotating the rollers 43, 44 in one direction 43*a*, 44*a* to position the tail in engagement with the port means, counter-rotating the rollers (as at 43*b*, 44*b*) to develop a predetermined length of tail on the port-equipped roller 44, momentarily stopping the counter-rotation of the port-equipped roller while re-rotating the other roller (FIGS. 14 and 31) to roll the log $L_2$ in the path and re-rotating the one roller 44 to feed the tail into the path.

In one embodiment the invention includes providing a mark M on the log L prior to the feeding step, and detecting said mark to orient the tail in a predetermined position. Further, the mark may be made using UV ink or ink in the visible range and on a trim end portion of the log.

Alternatively, the invention may include directing an air blast toward the log to displace the tail from a log being supported between the rollers, sensing the tail and rotating the log until the tail is in engagement with the port means.

The invention also includes providing a glue applying means 51 in the sealing station 42, the glue applying mens including an elongated member 54 disposed with its length transverse of the path P and cyclically bringing the partially unwound logs into contact with the member to apply glue G thereto and wherein the glue applying member is cyclically oscillated through a vertical arc from a glue source below the path into engagement with the underside of al partially unwound log in the path.

While in the foregoing specification, a detailed description of the invention has been set down for the purpose of illustration, many variations in the details hereingiven may be made by those skilled in the art without departing from the spirit and scope of the invention.

We claim:

1. A method for sealing the tail of a convolutely wound log comprising the steps of providing a longitudinally extending path including an infeed station and a sealing station, equipping said infeed station with a pair of spaced-apart, rotatable rollers having a nip therebetween, providing one of said rollers with vacuum port means in the periphery thereof, feeding logs sequentially into the nip between said pair of rollers, rotating said rollers, orienting the log tail to a position over said port means, rotating said rollers to unwind said tail, and rolling each log in said path through said nip into said sealing station.

2. The method of claim 1 in which said steps include rotating said log on its axis in one direction to achieve positioning said tail in engagement with said port means.

3. The method of claim 2 in which said steps include stopping the rotation of each log when said tail is engaged by said vacuum port means, and retaining the tail on said vacuum port means while counter-rotating said log to create a partially unwound log.

4. The method of claim 3 in which said steps include stopping the log counter-rotation and rolling said partially unwound log in said path toward said sealing station.

5. The method of claim 4 in which said steps include rolling said partially unwound log over a glue applicator for receipt of glue and while dragging said tail in said path.

6. The method of claim 1 in which said orienting step includes sensing the position of the tail for stopping the rotation of the rollers when the tail is over said port means.

7. The method of claim 1 in which said steps include directing an air blast toward said log to displace the tail from a log being supported between said rollers, sensing said tail and rotating said log until the tail is in engagement with said port means.

8. The method of claim 1 in which said steps include providing a glue applying means in said sealing station, said glue applying means comprising an elongated member disposed with its length transverse of said path and bringing the partially unwound logs into contact with said member to apply glue thereto.

9. The method of claim 8 in which said steps include cyclically pivoting said member through a vertical arc from a glue source below said path into engagement with the underside of a partially unwound log in said path.

10. The method of claim 1 in which said steps include providing glue applying means in said sealing station, operating said glue-applying means to apply an axial stripe of glue to the underside of each partially unwound log entering said sealing station, providing presser roll means downstream in said path of said glue-applying means with the distance between said glue applying means and said presser roller means being such as to position the glue stripe on the top of said partially unwound log when under said presser roll means, and rotating said presser roll means to simultaneously press the tail of the partially unwound log against the glue stripe and eject the now-sealed log from under said presser roller means.

11. The method of claim 1 in which said longitudinally extending path is substantially planar.

12. The method of claim 1 in which said spaced-apart rollers are generally vertically aligned.

13. The method of claim 12 in which said spaced-apart generally vertically aligned rollers rotate on fixed horizontal axes.

14. The method of claim 1 in which said feeding step includes the steps of rotating said rollers in the same direction with one of the rollers rotating faster than the other to advance a log into the nip and then rotating said rollers at the same speed to maintain the log in the nip.

15. A method for sealing the tail of a convolutely wound log comprising the steps of providing a longitudinally extending path including an infeed station and a sealing station, equipping said infeed station with a pair of spaced-apart, rotatable rollers, providing one of said rollers with vacuum port means in the periphery thereof, feeding logs sequentially into said pair of rollers, rotating said rollers in one direction to position said tail in engagement with said port means, counter-rotating said rollers to develop a predetermined length of tail on said port-equipped roller, momentarily stopping the counter-rotation of said port-equipped roller while re-rotating the other roller to roll said log in said path and re-rotating said port-equipped roller to feed said tail into said path, and rolling each log in said path into said sealing station.

16. A method for sealing the tail of a convolutely wound log comprising the steps of providing a longitudinally extending path including an infeed station and a sealing station, equipping said infeed station with a pair of spaced-apart, rotatable rollers, providing one of said rollers with vacuum port means in the periphery thereof, feeding logs sequentially into said pair of rollers, rotating said rollers, orienting the log tail to a position over said port means, rotating said rollers to unwind said tail, and rolling each log in said path into said sealing station, said steps including providing a mark on said log prior to said feeding step, and detecting said mark to orient the tail in said position.

17. The method of claim 16 in which said mark providing step includes using UV ink.

18. The method of claim 17 in which said mark providing step includes ink in the visible range and on a trim end portion of the log.

19. The method of claim 16 in which said steps include rotating said rollers in one direction to position said tail in engagement with said port means, counter-rotating said rollers to develop a predetermined length of tail on said port-equipped roller, momentarily stopping the counter-rotation of said port-equipped roller while re-rotating the other roller to roll said log in said path and re-rotating said port-equipped roller to feed said tail into said path.

20. A method for sealing the tail of a convolutely wound log comprising the steps of providing a longitudinally extending path including an infeed station and a sealing station, equipping said infeed station with a pair of spaced-apart, rotatable rollers, providing one of said rollers with vacuum port means in the periphery thereof, feeding logs sequentially into said pair of rollers, directing an air blast toward said log to displace the tail from a log being supported between said rollers, sensing said tail and rotating said log until the tail is in engagement with said port means, counter-rotating said rollers to develop a predetermined length of tail on said port-equipped roller, momentarily stopping the counter-rotation of said port-equipped roller while re-rotating the other roller to roll said log in said path and re-rotating said port-equipped roller to feed said tail into said path.

21. Apparatus for sealing the tail of a convolutely wound log comprising a frame providing a longitudinally extending path including an infeed station and a sealing station, a pair of spaced apart rotatable rollers having a nip therebetween, one of said rollers being equipped with vacuum port means on the periphery thereof, means for feeding logs sequentially into the nip between said pair of rollers, control means operably associated with said frame for orienting the log tail to a position over said port means, said control means also being operative to rotate said rollers to unwind said tail, and table means on said frame in said path, said control means also being operative to move a log through the nip between said pair of rollers and to eject a partially unwound log from said nip onto said table means and into said sealing station.

22. The apparatus of claim 17 in which said frame is equipped with air blast means to cause unwinding said tail for capture by said roller having said vacuum port means.

23. The apparatus of claim 21 in which said frame is equipped with glue applying means in said sealing station, said control means operating said glue-applying means to apply an axial stripe of glue to the underside of each partially unwound log entering said sealing station, presser roll means downstream in said path of said glue-applying means with the distance between said glue applying means and said presser roller means being such as to position the glue stripe on the top of said partially unwound log when under said presser roll means, said control means being operative to rotate said presser roll means to simultaneously press the tail of the partially unwound log against the glue stripe and eject the now-sealed log from under said presser roller means.

24. The apparatus of claim 21 in which said longitudinally extending path is substantially planar.

25. The apparatus of claim 21 which said spaced-apart rollers are generally vertically aligned.

26. The apparatus of claim 25 in which said spaced-apart generally vertically aligned rollers rotate on fixed horizontal axes.

27. Apparatus for sealing the tail of a convolutely wound log comprising a frame providing a longitudinally extending path including an infeed station and a sealing station, a pair of spaced apart rotatable rollers, one of said rollers being equipped with vacuum port means on the periphery thereof, means for feeding logs sequentially into the space between said pair of rollers, control means operably associated with said frame for orienting the log tail to a position over said port means, said control means also being operative to rotate said rollers to unwind said tail, and table means on said frame in said path, said control means also being operative to elect a partially unwound log from said space onto said table means and into said sealing station, each log is equipped with a mark located at the tail thereof, and detection means on said frame for detecting said mark to signal said control means for orienting said log.

28. Apparatus for sealing the tail of a convolutely wound log comprising a frame providing a longitudinally extending path including an infeed station and a sealing station, a pair of spaced apart rotatable rollers, one of said rollers being equipped with vacuum port means on the periphery thereof, means for feeding logs sequentially into the space between said pair of rollers, control means operably associated with said frame for orienting the log tail to a position over said port means, means for rotating said rollers responsive to said control means, said control means being operative to (a) rotate said rollers in one direction to position said tail in engagement with said port means, (b) counter-rotate said rollers to develop a predetermined length of tail on said port-equipped roller, (c) momentarily stop the counter-rotation of said port-equipped roller while re-rotating the other roller to roll said log in said path and (d) re-rotate said port-equipped roller to feed said tail into said path, and table means on said frame in said path, said control means also being operative to eject a partially unwound log from said space onto said table means and into said sealing station.

29. A method for sealing the tail of a convolutely wound log comprising the steps of providing a longitudinally extending path including an infeed station and a sealing station, equipping said infeed station with a pair of spaced-apart, rotatable rollers, providing one of said rollers with vacuum port means in the periphery thereof, feeding logs sequentially into said pair of rollers, rotating said rollers in one direction to position said tail in engagement with said port means, counter-rotating said rollers to develop a predetermined length of tail on said port-equipped roller, momentarily stopping the counter-rotation of said port-equipped roller while re-rotating the other roller to roll said log in said path, and rolling each log in said path into said sealing station.

30. A method for sealing the tail of a convolutely wound log comprising the steps of providing a longitudinally extending path including an infeed station and a sealing station, equipping said infeed station with a pair of spaced-apart, rotatable rollers, providing one of said rollers with vacuum port means in the periphery thereof, feeding logs sequentially into said pair of rollers, directing an air blast toward said log to displace the tail from a log being supported between said rollers, sensing said tail and rotating said log until the tail is in engagement with said port means, counter-rotating said rollers to develop a predetermined length of tail on said port-equipped roller, momentarily stopping the counter-rotation of said port-equipped roller while re-rotating the other roller to roll said log in said path.

31. Apparatus for sealing the tail of a convolutely wound log comprising a frame providing a longitudinally extending path including an infeed station and a sealing station, a pair of spaced apart rotatable rollers, one of said rollers being equipped with vacuum port means on the periphery thereof, means for feeding logs sequentially into the space between said pair of rollers, control means operably associated with said frame for orienting the log tail to a position over said port means, means for rotating said rollers responsive to said control means, said control means being operative to (a) rotate said rollers in one direction to position said tail in engagement with said port means, (b) counter-rotate said rollers to develop a predetermined length of tail of said port-equipped roller, (c) momentarily stop the counter-rotation of said port-equipped roller while re-rotating the other roller to roll said log in said path, and table means on said frame in said path.

* * * * *